US006853826B2

(12) United States Patent
Takahashi et al.

(10) Patent No.: US 6,853,826 B2
(45) Date of Patent: Feb. 8, 2005

(54) IMAGE READER, IMAGE FORMING DEVICE, AND BEARING RETAINING STRUCTURE

(75) Inventors: Takuji Takahashi, Tokyo (JP); Yoshiaki Nagao, Tokyo (JP); Sachiko Nishikino, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/238,769

(22) Filed: Sep. 11, 2002

(65) Prior Publication Data

US 2003/0049051 A1 Mar. 13, 2003

(30) Foreign Application Priority Data

Sep. 12, 2001 (JP) ..... 2001-276014

(51) Int. Cl.[7] ..... G03G 15/04
(52) U.S. Cl. ..... 399/211
(58) Field of Search ..... 399/211, 107, 399/117

(56) References Cited

U.S. PATENT DOCUMENTS

| | | | | |
|---|---|---|---|---|
| 3,807,616 A | | 4/1974 | Hope et al. | |
| 3,943,539 A | | 3/1976 | Bown et al. | |
| 4,710,017 A | | 12/1987 | Watanabe et al. | |
| 4,969,002 A | | 11/1990 | Nakayama | |
| 5,523,817 A | | 6/1996 | Morita | |
| 5,991,570 A | | 11/1999 | Haga et al. | |
| 6,275,668 B1 | * | 8/2001 | Batori | 399/90 |
| 2002/0034403 A1 | * | 3/2002 | Ueno et al. | 399/252 |
| 2002/0109864 A1 | * | 8/2002 | Nishikino et al. | 358/418 |

FOREIGN PATENT DOCUMENTS

| | | | | |
|---|---|---|---|---|
| JP | 4-001672 | | 1/1992 | |
| JP | 5-110768 | | 4/1993 | |
| JP | 5-145705 | | 6/1993 | |
| JP | 08312594 A | * | 11/1996 | F04D/29/60 |

* cited by examiner

*Primary Examiner*—Quana Grainger
(74) *Attorney, Agent, or Firm*—Oblon, Spivak, McClelland, Maier & Neustadt, P.C.

(57) ABSTRACT

A drive shaft, which is driven by a drive motor, is held firmly at two points by bearing structures. The bearing structure has a hole in which a bearing member is fit. The bearing member has hole, which is concentric with respect to the hole in which the bearing member is fit. A crimp, which is made of elastic material, having interfering portions that interfere with the bearing member is provided between the bearing member and the hole in the bearing structure in which the bearing member is fit.

23 Claims, 5 Drawing Sheets

IMAGE READER, IMAGE FORMING DEVICE, AND BEARING RETAINING STRUCTURE

BACKGROUND OF THE INVENTION

1) Field of the Invention

The present invention relates to the bearing structure for the drive mechanism, image reader and image forming device equipped with the image reader.

2) Description of the Related Art

An image reader that scans a surface of a paper (copy surface) and outputs (prints) an image of the copy surface as image data is widely known. In such image readers, a luminous source or a mirror is mounted on the moving body which freely carries out linear reciprocating motion under the contact glass. The light from the illuminant light source is directed on to the copy surface for illuminating it while the moving body is shifted in the secondary (sub) scanning direction along the copy surface mounted onto the contact glass. The light reflected from the copy surface, for every line in the main scanning direction is focused on a charge coupled device (CCD) and made to form an image.

A stepping motor is used to move the moving body. The driving force of the stepping motor is transmitted to a wire pulley (or a gear) provided on a drive shaft. A wire fixed to the moving body is wound around the wire pulley. Thus, when the stepping motor is driven, the moving body performs the reciprocating motion.

In the conventional image forming device, the drive shaft is such that the wire pulley is fixed to one end whereas the other end is inserted into the bearing fitted in a frame of the image forming device.

FIG. 10 shows a schematic longitudinal side view of the bearing section 200 into which the other end of the drive-shaft 300 is inserted. The bearing section 200 is composed of bearing hole 201 and bearing 202. The bearing hole 201 is made by cutting a notch in the frame 301 of the image reader. The bearing 202 has a flange 202*b* on one end of the bearing main body 202*a*. This flange 202*b* is made cylindrical in shape to enable the insertion of the drive shaft 300. The bearing section 200 is formed by inserting the bearing main body 202*a* of the bearing 202 into the bearing hole 201 and pressing the flange 202*b* against the frame body 301, thereafter, the drive shaft 300 is inserted into the bearing main body 202*a* of the bearing 202.

However the bearing section 200 has following problems. For example, if the gap between the bearing hole 201 and the bearing 202 is larger as shown in FIG. 11(*a*), the drive shaft 300 rattles in axial direction (i.e., X-axis) and radial direction (i.e., Y-axis). This rattle of the drive shaft 300 causes impulsive sound at the time of start up and stop as well as noise during the normal running due to the load while driving.

If the bearing 202 is press-fitted with respect to the bearing hole 201 as shown in FIG. 11(*b*), the bearing 202 might get tilted with respect to the bearing hole 201. If the bearing 202 gets tilted then the desired positioning accuracy of the bearing 202 with respect to the drive shaft 300 can not be achieved. If the bearing 202 can not be positioned accurately with respect to the drive shaft 300, a load is exerted on the drive shaft 300 resulting in lower driving efficiency (driving performance decrement) and lesser durability.

SUMMARY OF THE INVENTION

It is an object of this invention to provide the image forming device, image reader, and a bearing structure for the drive mechanism in the image forming device, which can prevent the decline in driving efficiency, decline in durability, impulsive sound at the time of start up and stop and noise during the normal operation by preventing the rattle of the bearing inserted into the bearing hole.

The bearing structure for a drive mechanism according to one aspect of the present invention comprises a first hole in a frame; a bearing member that is fit into the first hole, the bearing member having a second hole for inserting a drive shaft that is driven by a drive motor; and a crimp provided between the bearing member and the first hole, which crimps the bearing member in the first hole.

The image reader according to another aspect of the present invention employs the bearing structure according to the present invention.

The image forming device according to still another aspect of the present invention employs the bearing structure according to the present invention.

These and other objects, features and advantages of the present invention are specifically set forth in or will become apparent from the following detailed descriptions of the invention when read in conjunction with the accompanying drawings.

DETAILED DESCRIPTIONS

Embodiments of the present invention are explained below with reference to the accompanying FIG. 1 to FIG. 9. A digital copier is taken as an example of the image forming device, moreover, the scanner in the digital copier is taken as an example of the image reader for the sake of explanation.

Figure 1:
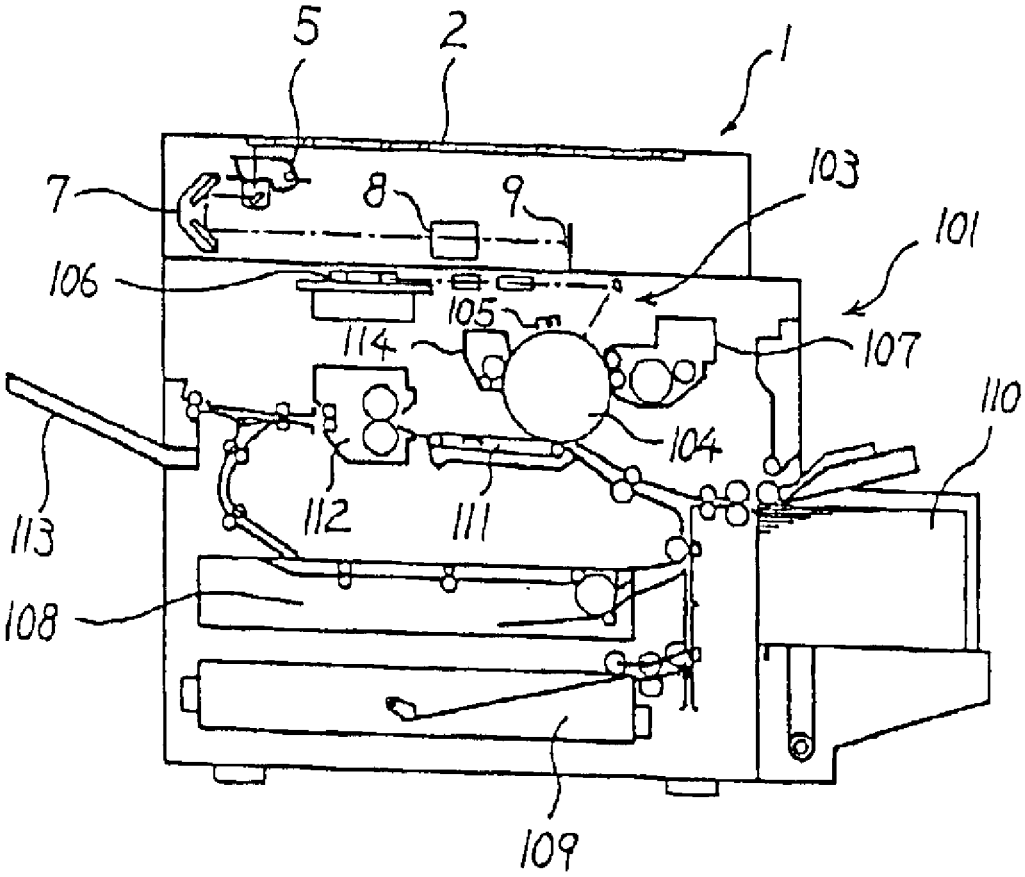
FIG. 1 is a schematic longitudinal front view, showing the internal structure of image forming device with the image reader mounted on it, according to an embodiment of the present invention.

FIG. 1 shows schematically the longitudinal front view of an internal structure of an image forming device 101 with an image reader 1 mounted on it, according to an embodiment of the present invention. The configuration of an image formation section 103, which outputs the image electrophotographically, of the image forming device 101 is widely known. Therefore, the configuration of the image formation section 103 will be explained only briefly.

In the image formation section 103, the periphery (outer side) of a photoelectric body 104 is charged evenly by a charger 105. Electrostatic latent image is inscribed on the charged part of the photo electric body 104 by a photo inscribing unit 106 based on the image data of the copy paper read by the image reader 1. This electrostatic latent image is developed by a processing device (development counter) 107 and the developed image on the photo electric body 104 is transferred by a transferring belt 111 on to the paper fed by any of paper feeding sections 108, 109, or 110. The paper is then forwarded to a fixing device 112 and is discharged into a discharge tray 113 after the transferred image is fixed on it. The toner that remains on photoelectric body 104 is cleaned by a cleaning unit 114. Thus, the image formation device becomes ready for preparing the next image.

Figure 2:
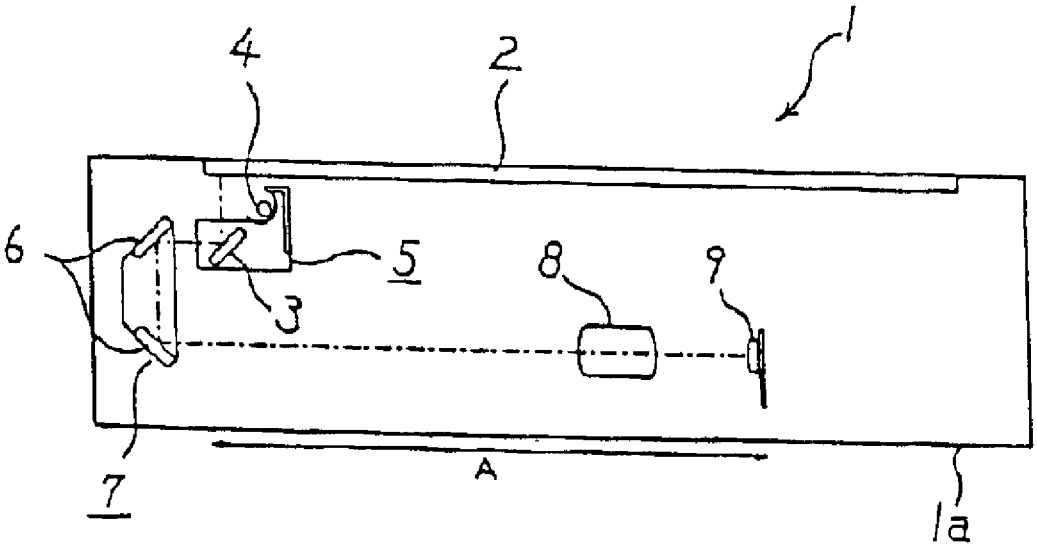
FIG. 2 is a schematic longitudinal front view of the structure of the image reader.

Configuration of the image reader 1 will be explained now. FIG. 2 shows schematically the longitudinal front view of structure of the image reader 1. A contact glass 2 is provided, above a tray 1*a* of the image reader 1, for mounting the copy paper (not shown in the figure). A first carriage 5, with a reflecting mirror 3 and an illuminating lamp (Xe lamp) 4 mounted on it, is placed in the position facing the contact glass 2 from below. The first carriage 5 is positioned such that it can move freely in secondary scanning direction shown by an arrow A. A second carriage 7 which reflects the optical path of the rays reflected by two reflecting mirrors 6, is positioned in the optical path of reflection of the first carriage 5 in such a way that it can move freely in the secondary scanning direction. A charge couple device (CCD) 9, which is an image sensor, and an image forming lens 8 are positioned in the optical path of the light reflected by the second carriage 7. The reflecting mirror 3 and the illuminating lamp 4 mounted on the first carriage 5, and the two reflecting mirrors 6 mounted on the second carriage 7, form the respective optical reading systems. A pressure plate (not shown in the figure) holds the copy papers mounted on to the contact glass 2.

Figure 3:
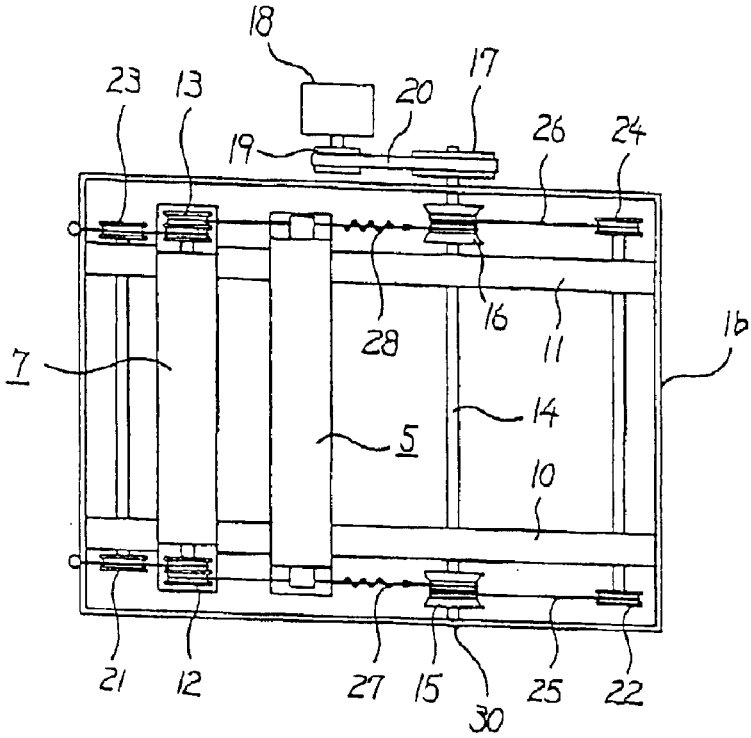
FIG. 3 is a top view of the mechanism for movement of the first and second carriages in the secondary scanning direction.
Figure 4:
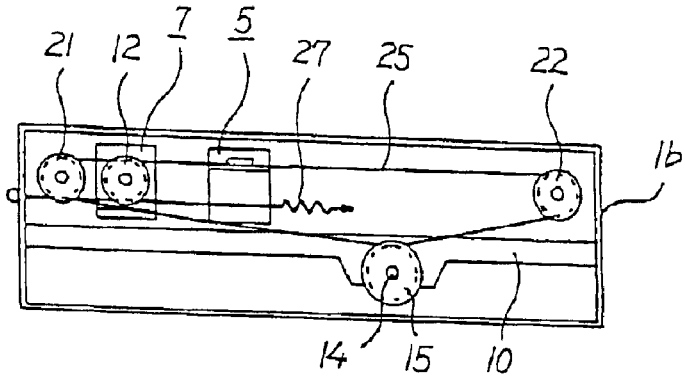
FIG. 4 is a front view of the mechanism for movement of the first and second carriages in the secondary scanning direction.

The mechanism that realizes the movement of the first carriage 5 and second carriage 7 in the secondary scanning direction will be explained with reference to FIG. 3 and FIG. 4. FIG. 3 shows a top view and FIG. 4 shows a side view of this mechanism. The image reader 1 has frame 1*b* inside of the tray 1*a*. There are two parallel rails 10 and 11 in this frame 1*b*. The rails 10 and 11 support two freely sliding carriages 5 and 7 that are placed longitudinally at right angle to rails 10 and 11. Double grooved pulleys 12 and 13 are provided on two ends of the secondary carriage 7.

A drive shaft 14 is positioned under the rails 10 and 11 at right angles to the rails 10 and 11. Wire pulleys 15 and 16 are positioned between the side surface of frame 1*b* and rails 10 and 11 respectively of the drive shaft 14. One end of the drive shaft 14 is protruding out from the frame 1*b* and a pulley 17 is fixed on this protruding end. A belt 20 is wound on pulley 17 to transmit the driving force from a pulley 19 connected to a drive shaft of a stepping motor 18. The other end of the drive shaft 14 is inserted into a bearing section 30 on the frame 1*b*.

Idler pulleys 21, 22, 23 and 24 are provided near both rails 10 and 11.

One end of each of wires 25 and 26 are fixed to the side wall of the frame 1*b*. The wire 25 is put on the double grooved pulley 12, the idler pulley 21, then wound few turns around the wire pulley 15, and put on the idler pulley 22 and the double grooved pulley 12. The other end of the wire coming through spring 27 is fixed to the frame 1*b*. One ends of the first carriage 5 and the second carriage 7 are fixed between the idler pulley 22 and the double grooved pulley 12.

Similarly, wire 26 is put on the double grooved pulley 13 and the idler pulley 23, then a few turns of the wire 26 are wound around the wire pulley 16, and put on the idler pulley 24 and the double grooved pulley 13. The other end of the wire coming through spring 28 is fixed to the frame 1*b*. Other ends of the first carriage 5 and the second carriage 7 are fixed between the idler pulley 24 and the double grooved pulley 13. Thus, the two carriages 5 and 7 are supported by wires 25 and 26 passed over the idler pulleys 21, 22, 23 and 24. The idler pulleys 21, 22, 23 and 24 function as pivots for the carriages 5 and 7.

The wire pulleys 15 and 16 are rotated by the driving force of the stepping motor 18. Since the wires 25 and 26 are wound around the wire pulleys 15 and 16 respectively, the wires 25 and 26 move as the wire pulleys 15 and 16 rotate. Since the carriages 5 and 7 are fixed to the wires 25 and 26, the carriages 5 and 7 move as they are pulled by wires 25 and 26 when the wires 25 and 25 move. The ratio of moving speeds of the first carriage 5 and second carriage 7 in the secondary scanning direction A (see FIG. 2) is 2:1

How the surface of the copy paper is read (reading operation) will be explained next with reference to FIG. 2. The copy paper (not shown in the figure) is mounted on to the contact glass 2. The two carriages 5 and 7 are positioned first in the home position, i.e., the position shown in FIG. 2. The two carriages 5 and 7 are then made to move with the ratio of moving speed 2:1 towards the right direction (i.e., the secondary scanning direction A). While the two carriages 5 and 7 are moving, the light from the illuminating lamp 4 is illuminated on the copy paper. The light reflected from the surface of the copy paper falls on the mirrors 3 and 6. The light reflected from the mirrors 6 passes through the forming lens 8 and falls on the CCD 9 where an image of the surface of the copy paper is formed.

Figure 5:
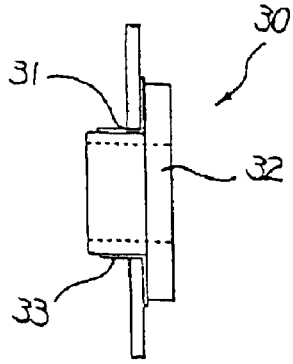
FIG. 5 is a longitudinal side view of a bearing structure according to the embodiment of the present invention.

Detailed explanation of the bearing section 30 into which the other end of the drive shaft 14 is inserted will be given now. FIG. 5 shows the longitudinal side view of the bearing section 30. The bearing section 30 is composed of a bearing hole 31, a bearing 32, and a crimp member 33 inserted between the bearing hole 31 and the bearing 32.

Figure 6:
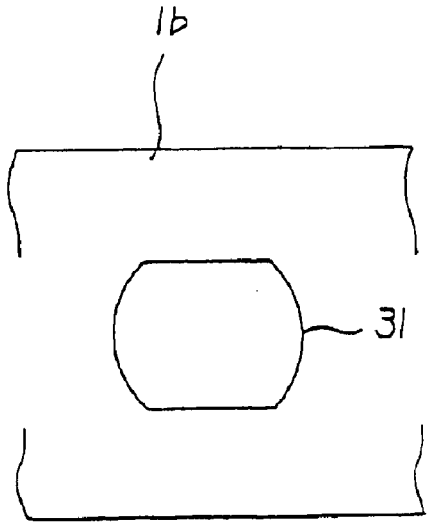
FIG. 6 is a front view of a bearing hole in the bearing structure.

The bearing hole 31 is made by cutting a notch in the frame 1*b* of the image reader 1. The shape of the bearing hole 31 is that of a circle made flat at the top and bottom as shown in FIG. 6.

Figure 7A:
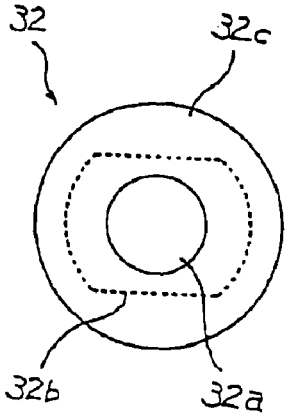
FIG. 7A is a front and FIG. 7B is a side view of the bearing.
Figure 7B:
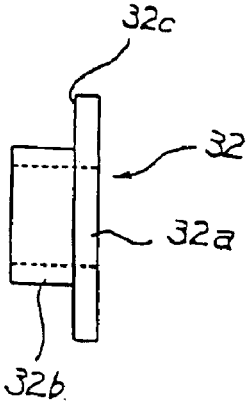

The bearing 32 has a flange 32 on one end of the bearing main body 32*b* which has an insertion hole 32*a* for inserting the drive shaft 14 as shown in FIG. 7A and FIG. 7B. The outer shape of the bearing main body 32*b* is almost same as that of the bearing hole 31, and the bearing main body 32*b* is little smaller than the bearing hole 31 so that the bearing main body 32*b* fits into the bearing hole 31.

Figure 8:
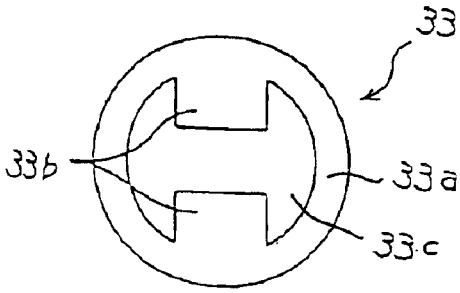
FIG. 8 is a front view of the crimping member according to the embodiment of the present invention.

The crimp member 33 is made up of elastic material in the form of thin sheet like plastic as shown in FIG. 8. This crimp member 33 is made of the roughly ring shaped ring 33*a* which allows the insertion of the bearing main body 32*b* of the bearing 32 and two protrusions 33*b* positioned symmetrically protruded from ring 33*a* towards the center.

Going into further details, these two protrusions 33*b* are the interfering portions that interfere with the bearing 32 and they are placed in positions to interfere with the bearing main body 32*b* of the bearing 32 which is inserted into the hole 33*c* in the crimp member 33.

Figure 9A:
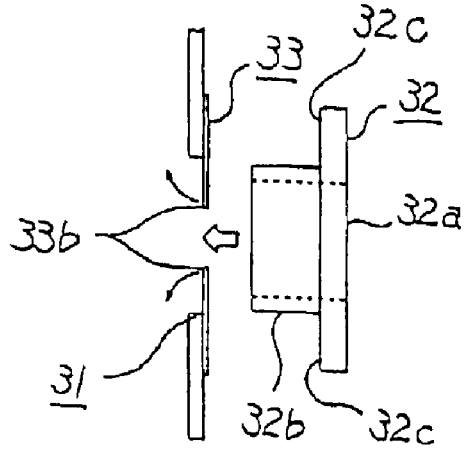
FIG. 9A is a side view that shows the condition prior to inserting the bearing into the bearing hole.
Figure 9B:
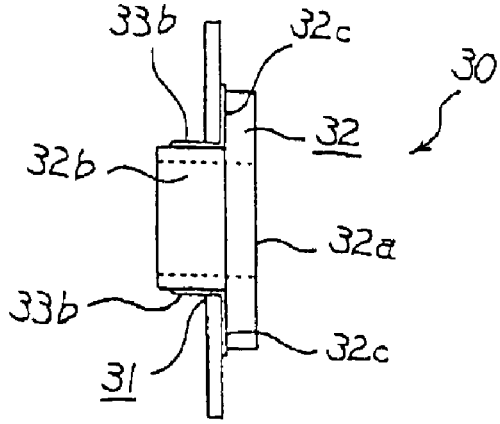
FIG. 9B is a side view showing the condition after inserting the bearing into the bearing hole.

After superposing (or sticking) the crimp member 33 on the bearing hole 31, the bearing main body 32*b* of the bearing 32 is fitted into the bearing hole 31 and inside of the crimp member 33 as shown in FIG. 9A. The flange 32*c* is pressed against the frame 1*b* through the ring 33*a* of the crimp member 33. As a result, the two protrusions 33*b* of the crimp member 33 get bent as shown in FIG. 9B, as they are pressed by the bearing main body 32*b* of the bearing 32 inserted inside. Thus, since the crimp member 33, which is made of thin sheet of elastic material, is bent after being pressed by the bearing main body 32*b* of bearing 32, it is pressure welded resiliently to the flat portion of the bearing main body 32*b* of bearing 32. Thus, even if there is a small gap between the bearing hole 31 and bearing 32, the bearing 32 will not rattle because the crimp member 33 will suppress any rattle. The bearing 32 can be crimped firmly in the bearing hole 31 because of the two protrusions 33*b* provided symmetrically with respect to the bearing 32. It is needless to say that the drive shaft 14 is inserted into the inserting hole 32*a* of the bearing 32.

Figure 10:
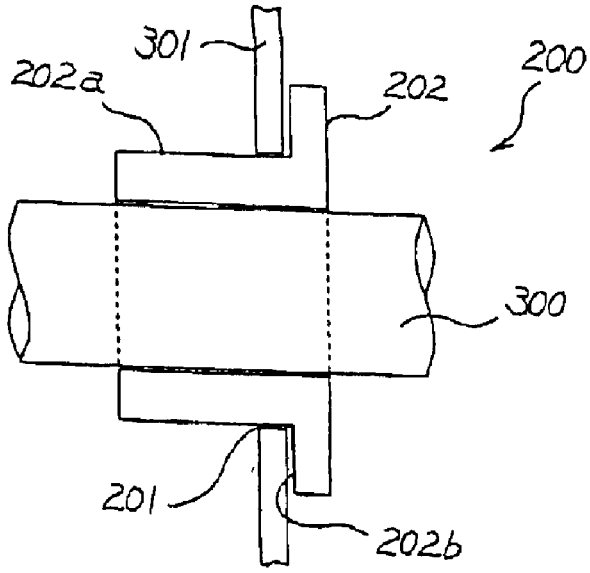
FIG. 10 is a schematic longitudinal side view of a conventional bearing structure.
Figure 11A:
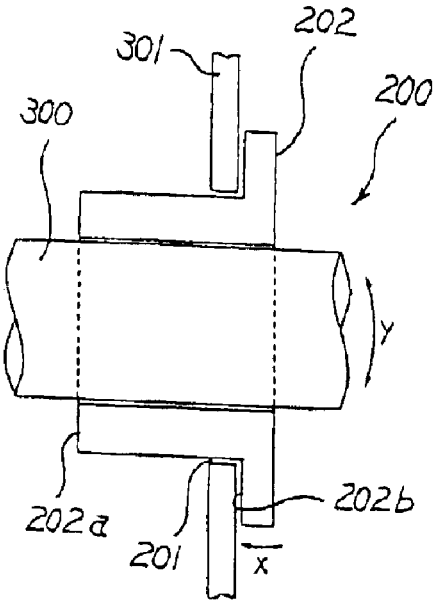
FIG. 11A and FIG. 11B are for explaining the problems in the conventional bearing structure.
Figure 11B:
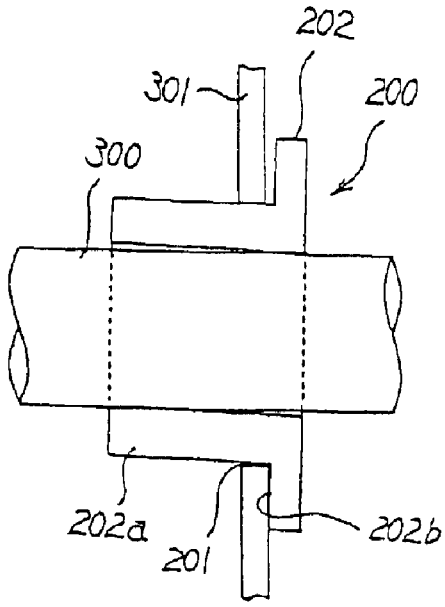

In the conventional bearing section 200 (see FIG. 10), the rattle is caused in the axial and radial of the drive shaft 14 if the gap between the bearing 32 and bearing hole 31 is wide. However, according to the embodiment of the present invention, the rattle in the axial and radial of the drive shaft 14 is not caused because of the provision of the crimp member 33 between the bearing 32 and bearing hole 31 thereby crimping the bearing 32 in the bearing hole 31. Since there is no rattle, there will be no impulsive sound at the time of start up and stop, noise during normal operation caused due to the load exerted while driving. In addition, there will be no decline in driving efficiency or decline in durability.

Due to the interference of protrusions 33*b*, made of elastic material in the form of a thin sheet of crimp member 33, positioned at right angle face with respect to the axial of the drive shaft, with the corresponding bearing 32 when the bearing 32 is fitted into the bearing hole 31, the bearing 32 is made to crimp in the bearing hole 31. This is aimed at simplifying the assembling of the crimp member 33 with the bearing 32 and fabrication of the crimp member 33.

It was assumed in this embodiment that the image formation section 103 employs the electrophotographic system. However, it is by no means limited to this. For example, the image formation section 103 may employ a printing method that is employed in the ink jet printers, thermal sublimation, the silver halide photography, direct thermal recording method, thermal hot melt printing, etc. The detailed explanation is omitted here, as the specific constitution has been known widely.

According to the bearing structure for drive mechanism of the present invention the bearing is fabricated such that it fits loosely into the bearing hole and a crimp member is provided to crimp the bearing in the bearing hole thereby filling the gap between the bearing and bearing hole. As a result the drive draft does not rattle. This enables to prevent the impulsive sound at the time of start up and stop, noise during the normal operation caused due to the load exerted while driving, decline in driving efficiency (driving performance decrement) and decline in durability.

The bearing structure for drive mechanism of the present invention is used in the image reader of the present invention. Thus, it is possible to have an image reader which is silent, efficient and durable.

The bearing structure for drive mechanism of the present invention is used in the image forming device of the present invention. Thus, it is possible to have an image forming device which is silent, efficient and durable.

The present document incorporates by reference the entire contents of Japanese priority document, 2001-276014 filed in Japan on Sep. 12, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A bearing structure for a drive mechanism comprising:

a first hole in a frame;

a bearing member that is fit into the first hole, the bearing member having a second hole for inserting a drive shaft that is driven by a drive motor; and a crimp provided between the bearing member and the first hole, which crimps the bearing member in the first hole;

wherein the crimp is made of elastic material in the form of a thin sheet, wherein the crimp having a third hole for inserting the bearing member and the drive shaft;

and at least one interfering portion that interferes with the bearing member when the bearing member is inserted in the third hole.

2. The bearing structure according to claim 1, wherein there are two interfering portions and the interfering portions are provided symmetrically on opposite side with respect to the third hole.

3. An image reader comprising:

a moving body fixed to two wires;

a drive shaft having two ends, one pulley provided at each end, the wires being wound around the corresponding pulleys, a motor that drives the drive shaft to thereby realize reciprocating motion of the moving body;

and a frame having two first holes, a bearing structure being fitted into each first hole, each bearing structure having a bearing member that is fit into the corresponding first hole, the bearing member having a second hole for inserting the drive shaft; and a crimp provided between the bearing member and the first hole, which crimps the bearing member in the corresponding first hole.

4. An image forming device comprising:

an image reader that scans a surface of a medium to acquire image data of the surface; and an image forming section that forms and prints an image of the surface based on the image data acquired by the image reader, the image reader including a moving body fixed to two wires;

a drive shaft having two ends, one pulley provided at each end, the wires being wound around the corresponding pulleys, a motor that drives the drive shaft to thereby realize reciprocating motion of the moving body; and a frame having two first holes, a bearing structure being fitted into each first hole, each bearing structure having a bearing member that is fit into the corresponding first hole, the bearing member having a second hole for inserting the drive shaft; and a crimp provided between the bearing member and the first hole, which crimps the bearing member in the corresponding first hole.

5. A bearing structure for a drive mechanism comprising:

a first hole in a frame;

a bearing means fit into the first hole, the bearing means having a second hole for inserting a drive shaft that is driven by a drive motor; and a crimp means provided between the bearing means and the first hole for crimping the bearing means in the first hole.

6. An image reader comprising:

a moving means, fixed to two wires, for holding optical components for scanning a surface of a medium;

a drive shaft having two ends, one rotating means provided at each end, the wires being wound around the corresponding rotating means, a driving means that drives the drive shaft to thereby realize reciprocating motion of the moving means; and a frame means having two first holes, a bearing structure being fitted into each first hole, each bearing structure having a bearing means fit into the corresponding first hole, the bearing means having a second hole for inserting the drive shaft; and a crimp means provided between the bearing means and the first hole for crimping the bearing means in the first hole.

7. An image reader comprising:

an image reading means that scans a surface of a medium to acquire image data of the surface; and an image forming means that forms and prints an image of the surface based on the image data acquired by the image reading means, the image reading means including a moving means, fixed to two wires, for holding optical components for scanning a surface of a medium;

a drive shaft having two ends, one rotating means provided at each end, the wires being wound around the corresponding rotating means, a driving means that drives the drive shaft to thereby realize reciprocating motion of the moving means; and a frame means having two first holes, a bearing structure being fitted into each first hole, each bearing structure having a bearing means fit into the corresponding first hole, the bearing means having a second hole for inserting the drive shaft; and a crimp means provided between the bearing means and the first hole for crimping the bearing means in the first hole.

8. A bearing structure for a drive mechanism comprising:

a first hole in a frame;

a bearing member that is fit into the first hole, the bearing member having a second hole for inserting a drive shaft that is driven by a drive motor; and a crimp member separate from the bearing member and provided between the bearing member and the first hole, which tightly crimps the bearing member in the first hole, whereby the bearing member is prevented from rattling.

9. The bearing structure according to claim 8, wherein the crimp member comprises a ring portion and a protrusion extending from an inner portion of the ring portion.

10. The bearing structure according to claim 9, wherein the protrusion extends within the first hole whereby the protrusion is provided between the bearing member and the first hole.

11. The bearing structure according to claim 8, wherein the crimp member comprises a ring portion and a plurality of protrusions extending from an inner portion of the ring portion.

12. The bearing structure according to claim 11, wherein the plurality pf protrusions extend within the first hole whereby the plurality of protrusions are provided between the bearing member and the first hole.

13. A bearing structure for a drive mechanism comprising:

a first hole in a frame;

bearing means that is fit into the first hole, the bearing means having a second hole for inserting a drive shaft that is driven by a drive motor; and means for crimping provided between the bearing means and the first hole, which crimps the bearing means in the first hole;

wherein the means for crimping is made of elastic material in the form of a thin sheet, wherein the means for crimping includes a third hole for inserting the bearing means and the drive shaft;

and at least one interfering portion that interferes with the bearing means when the bearing means is inserted in the third hole.

14. A bearing structure for a drive mechanism comprising:

a first hole in a frame, the first hole being non-circular in shape;

a bearing member that is fit into the first hole, the bearing member having a second hole for inserting a drive shaft that is driven by a drive motor; and a crimp member provided between the bearing member and the first hole, which tightly crimps the bearing member in the first hole, whereby the bearing member is prevented from rattling.

15. The bearing structure according to claim 14, wherein the bearing member has an outer surface that has a shape that is identical to a shape of the first hole.

16. The bearing structure according to claim 14, wherein the first hole has a circular portion and a flat portion, and wherein the bearing member has an outer surface with a circular portion and a flat portion.

17. The bearing structure according to claim 16, wherein the crimp member comprises a ring portion and a protrusion extending from an inner portion of the ring portion, and wherein the protrusion extends within the first hole between the flat portion of the bearing member and the flat portion of the first hole.

18. The bearing structure according to claim 14, wherein the first hole has a first circular portion, a first flat portion, a second circular portion, and a second flat portion, and wherein said bearing member has an outer surface with a first circular portion, a first flat portion, a second circular portion, and a second flat portion.

19. The bearing structure according to claim 18, wherein the crimp member comprises a ring portion, a first protrusion and a second protrusion, wherein the first protrusion and the second protrusion extend from an inner portion of the ring portion, wherein the first protrusion extends within the first hole between the first flat portion of the bearing member and the first flat portion of the first hole, and wherein the second protrusion extends within the first hole between the second flat portion of the bearing member and the second flat portion of the first hole.

20. The bearing structure according to claim 14, wherein the crimp member comprises a ring portion and a protrusion extending from an inner portion of the ring portion.

21. The bearing structure according to claim 20, wherein the protrusion extends within the first hole whereby the protrusion is provided between the bearing member and the first hole.

22. The bearing structure according to claim 14, wherein the crimp member comprises a ring portion and a plurality of protrusions extending from an inner portion of the ring portion.

23. The bearing structure according to claim 22, wherein the plurality pf protrusions extend within the first hole whereby the plurality of protrusions are provided between the bearing member and the first hole.

* * * * *